US005590595A

United States Patent [19]

Thompson et al.

[11] Patent Number: 5,590,595

[45] Date of Patent: Jan. 7, 1997

[54] METHOD AND APPARATUS FOR MULTI-PRINTHEAD INTERMITTENT MOTION IMPRINTING

[75] Inventors: James A. Thompson, Downers Grove; Charles R. Barczak, Justice; Arthur D. Jezuit, Wood Dale, all of Ill.

[73] Assignee: Illinois Tool Works Inc., Glenview, Ill.

[21] Appl. No.: 507,764

[22] Filed: Jul. 26, 1995

[51] Int. Cl.[6] ..... B31F 1/07

[52] U.S. Cl. ..... 101/10; 101/9; 101/27

[58] Field of Search ..... 101/9, 21, 31, 101/27, 193, 487, 10

[56] References Cited

U.S. PATENT DOCUMENTS

| | | | |
|---|---|---|---|
| 3,634,174 | 1/1972 | Warsager | 101/38.1 |
| 3,878,776 | 4/1975 | Schneider | 400/118.1 |
| 4,160,410 | 4/1979 | Fichter | 101/10 |
| 4,416,199 | 11/1983 | Davison | 101/27 |

*Primary Examiner*—John S. Hilten
*Attorney, Agent, or Firm*—Schwartz & Weinrieb

[57] ABSTRACT

A method and apparatus for a hot stamp imprinter which imprints ink from an inked print ribbon onto a substrate. The imprinter includes multiple printhead assemblies, with one or more heater elements, mounted on a frame. An actuatable backup assembly, also mounted on the frame, corresponds to each printhead assembly, wherein the backup assemblies are actuatable in series or parallel, to move, from a rest position, toward the printhead assembly, to an imprint position, to transfer ink from the print ribbon onto the substrate. A temperature probe disposed in each printhead is coupled to the control unit, which individually and sequentially energizes the heater elements of the respective printheads so that only one printhead assembly is energized at any one time. A spring biased dancer assembly having a idler roller maintains a tension on the inked print ribbon as the inked print ribbon is transferred from a supply reel to a rewind reel. The dancer assembly is coupled to a first encoder which controls a drag brake on the supply reel based on a position of the dancer assembly. A second idler roller is coupled to a second encoder for measuring the rate at which the ribbon is transferred from the supply reel to the rewind reel. The control unit increments the inked print ribbon a short interval to move an unused portion of the inked print ribbon between the printhead and backup assemblies, and then, after a subsequent imprint, increments the print ribbon a long interval to move an unused portion of the ribbon between the printhead and backup assemblies.

22 Claims, 3 Drawing Sheets

METHOD AND APPARATUS FOR MULTI-PRINTHEAD INTERMITTENT MOTION IMPRINTING

FIELD OF THE INVENTION

The present invention generally relates to a hot stamp imprinter, and more specifically, to a multi-printhead intermittent motion imprinter for imprinting information on a substrate.

BACKGROUND OF THE INVENTION

Many applications require high quality text or graphics like logos, UPC codes, lot numbers, prices, expiration dates, FDA/USDA nutritional statements, and other variable information to be printed on a substrate formed of flexible packaging films and rigid or semi-rigid materials. One of the printing technologies suitable for this type of printing is hot stamp imprinting, wherein a pigmented or inked ribbon and the substrate are compressed between a high temperature, thermal printhead and a pneumatically actuated backup assembly to transfer, or imprint, the pigment or ink from the ribbon onto the substrate. In the past, the efficiency of the imprinting process has been increased by including multiple printhead and backup assemblies to make a corresponding number of imprints on the substrate. In some applications, the available air supply, often supplied by a host packaging machine, limits the number and size of the printheads that may be operated at any one time. Prior art imprinters however do not provide means for controlling the air pressure supplied to the backup assemblies to ensure proper imprinting. In other applications, the printhead is reconfigured with different size print plates or steel type for printing lines of variable text, like expiration dates. The printheads of prior art imprinters however are not readily reconfigured and often require substantial disassembly to change the print plate or change the steel type. Further, changes in printhead configuration may require a change in air pressure for actuating the backup assembly to ensure proper imprinting and to prevent damage to the print ribbon and substrate. As discussed above, however, prior art imprinters do not provide means for controlling the air pressure supplied to the backup assemblies and therefore can not accommodate different printhead configurations without imprinter modification which often requires substantial disassembly. Prior art imprinters also have the disadvantage of requiring a considerable amount of electrical power for energizing the heater elements in the printheads and the print ribbon advance motor. Further, prior art imprinters often waste print ribbon. For example, during the imprinting process, prior art imprinters intermittently advance the print ribbon and the substrate between the one or more thermal printhead and backup assemblies, wherein the print ribbon is moved a fixed displacement interval, or increment, between imprints to position an unused portion of the ribbon between printhead and backup assemblies for the next imprint. Moving the print ribbon a fixed displacement interval between print strokes, however, does not efficiently utilize the ink on the ribbon, and results in significant ribbon waste. Also, during power down, print ribbon in prior art imprinters is often free to unwind from the supply reel which also results in unnecessary waste. Moreover, prior art imprinters do not monitor ribbon supply, or provide means for diagnosing the status of the imprinter.

OBJECTS OF THE INVENTION

In view of the discussion above, there exists a demonstrated need for an advancement in the art of hot stamp imprinting. It is therefore an object of the present invention to provide a novel method and apparatus for an imprinter.

It is also an object of the present invention to provide a novel imprinter with multiple thermal printheads for economically imprinting on a substrate.

It is another object of the present invention to provide a novel imprinter with backup assemblies that are actuateable in series or in parallel.

It is another object of the present invention to provide a novel imprinter in which air pressure supplied to the backup assemblies is variable to accommodate different printhead configurations.

It is a further object of the present invention to provide a novel imprinter that minimizes the amount of energy required to operate the imprinter by individually and sequentially energizing heater elements of the multiple printheads.

It is still another object of the present invention to provide a novel imprinter that is controlled by a microprocessor based control unit that controls the temperature of the printheads based on a measured temperature of the printheads.

It is yet a further object of the present invention to provide a novel imprinter, wherein the inked print ribbon is intermittently advanced alternate short and long increments to position an unused portion of the print ribbon between the printhead and backup assemblies.

It is still a further object of the present invention to provide a novel imprinter with a control unit having an operator input panel for inputting backup assembly actuation delay time, dwell time, printhead temperature, and other operator input parameters, and an indicator or terminal blocks for providing an output signal to an external indicator, for indicating a status of the imprinter.

SUMMARY OF THE INVENTION

Accordingly, the present invention is directed toward a novel method and apparatus for a hot stamp imprinter which imprints ink from an inked print ribbon onto a substrate. The imprinter includes multiple printhead assemblies, each having one or more heater elements, mounted on a frame. An actuatable backup assembly, also mounted on the frame, corresponds to each printhead assembly, and each backup assembly includes a slider block and an air cylinder for receiving compressed air. A solenoid actuatable air valve routes compressed air into and out of the air cylinder, wherein the backup assembly moves, from a rest position, toward the printhead assembly, to an imprint position, to transfer ink from the print ribbon onto the substrate when compressed air is routed into the air cylinder. The backup assembly moves from the compress position to the rest position when compressed air is routed from the air cylinder. The backup assemblies may be actuated in series or in parallel, and the delay between actuation may be varied to control air pressure supplied to the assemblies. In one embodiment, the imprinter includes a control unit which actuates the solenoids in series or in parallel to move the backup assemblies from the rest position to the imprint position. To conserve energy, a temperature probe disposed in each printhead is coupled to the control unit, Which individually and sequentially energizes the heater elements of the respective printheads so that only one printhead assembly is energized at any one time. The imprinter includes a ribbon supply reel, and a rewind reel, wherein the inked print ribbon is routed from the ribbon supply reel, between the printhead and backup assemblies, to the rewind reel. A stepper motor and a one-way clutch rotatably coupled to the rewind reel transfers the inked print ribbon from the supply reel to the rewind reel. A spring biased dancer assembly having an idler roller maintains tension on the inked print ribbon as the ribbon is transferred from the supply reel to the rewind reel. The dancer assembly is coupled to a first encoder which varies a supply voltage to an electromagnetic brake, based on the position of the dancer assembly, to control print ribbon tension supplied from the supply reel. A second idler roller is coupled to a second encoder to measure the rate at which the ribbon is transferred from the supply reel to the rewind reel, and a pressure roller maintains the inked print ribbon in contact with the second idler roller to ensure accurate measurement. After an initial imprint, the control unit increments the inked print ribbon a short interval to move an unused portion of the inked print ribbon between the printhead and backup assemblies, and then, after a subsequent imprint, the control unit increments the print ribbon a long interval to move an unused portion of the ribbon between the printhead and backup assemblies. The control unit has an input panel with numeric and function keys programmable by an operator for controlling the operation and diagnostic analysis of the imprinter.

BRIEF DESCRIPTION OF THE DRAWINGS

These and other objects, features and advantages of the present invention will become apparent upon consideration of the following Detailed Description of the Invention with the accompanying drawings in which like reference characters designate like or corresponding parts throughout the several views, and wherein.

DETAILED DESCRIPTION OF THE INVENTION

Figure 1:
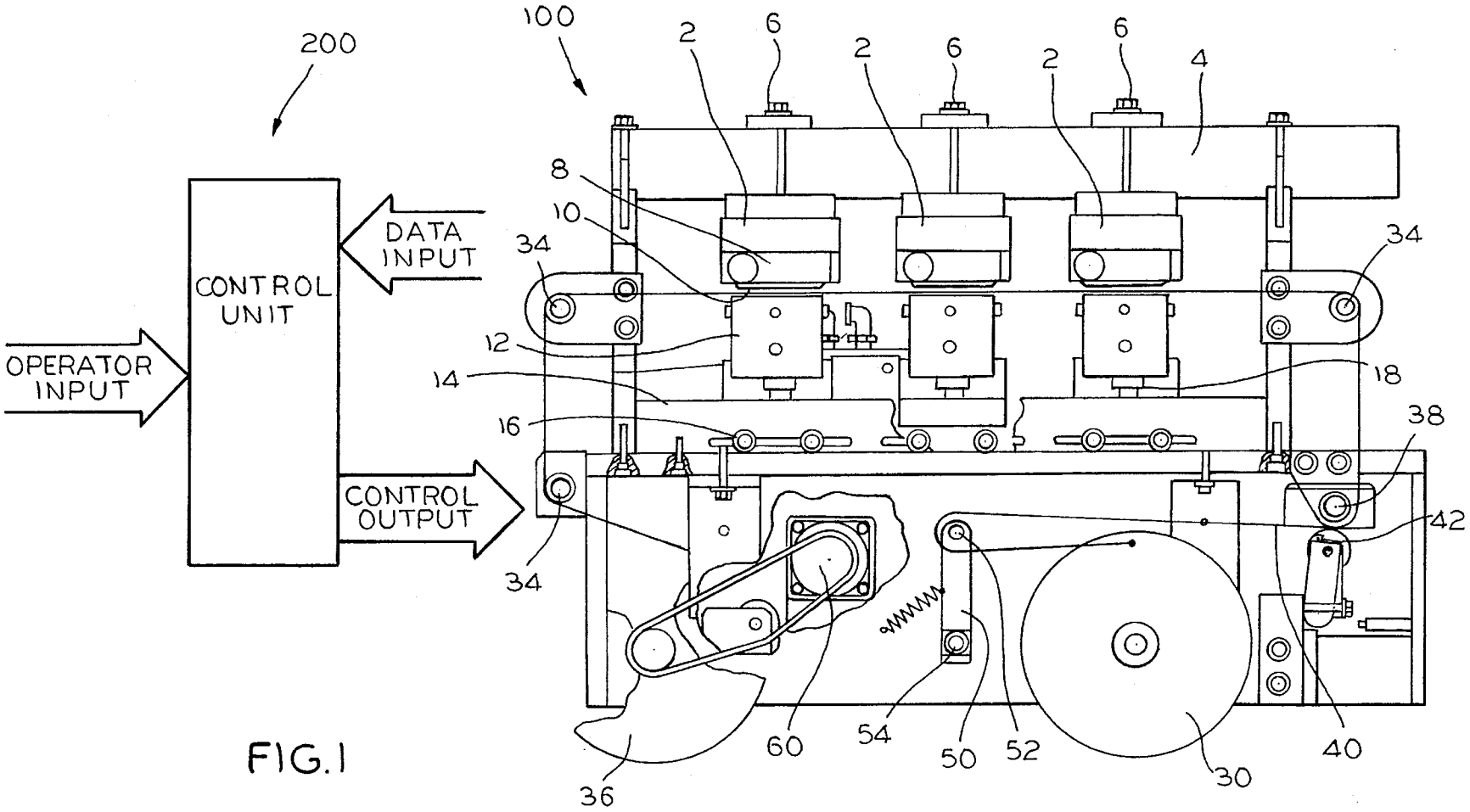
FIG. 1 is a partial side view of a multi-printhead intermittent motion imprinter including an imprinter assembly and control unit.

FIG. 1 is a partial side view of a multi-printhead intermittent motion imprinter generally comprising an imprinter assembly 100 which in one embodiment is coupled to a microprocessor based control unit 200 by interconnecting cables not shown in the drawing. The imprinter assembly 100 is installed on a host packaging machine having a substrate, not shown in the drawing, on which information is to be imprinted. The control unit 200 includes an ON/OFF switch for energizing and de-energizing the imprinter 100, and an operator input panel with a keypad having numeric and function keys for inputting operator selectable inputs such as printhead temperature, dwell time, delay time and ribbon feed rate as further discussed below. The control panel may also include diagnostic inputs for isolated operation of individual imprinter and control unit components and subassemblies discussed below. In one embodiment, the imprinter includes a red warning light mounted thereon, and a terminal block for coupling to an auxiliary indicator, to indicate the status of the imprinter.

The imprinter assembly 100 includes a series of printhead assemblies 2 adjustably mounted on a cross bar 4 of a frame, and secured thereto by cap screws 6. In alternative embodiments, the frame has different size configurations for accommodating more or less printhead assemblies 2 as required for printing on different size substrates. Each printhead assembly 2 includes a heater element to provide a uniform temperature distribution in the printhead assembly 2, and a temperature probe, for example, a resistance temperature detector, to measure the temperature of the printhead 2. The temperature probe provides a temperature signal to the control unit 200 which controls the printhead assembly temperature based on the measured printhead temperature and an operator selected printhead temperature. In an alternative embodiment, the printhead assembly 2 includes multiple heater elements to ensure a uniform temperature distribution, and multiple temperature sensors, wherein the required number of heater elements and sensors depend on the physical size of the printhead assembly 2. To conserve energy, the control unit individually and sequentially strobes, or energizes, the heater element, or elements, of the individual printhead assemblies 2 so that only one printhead assembly 2 draws power at any given time. Each printhead assembly 2 also includes a typeholder 8 on which is mounted, for example, by a dovetail and set screw, a print plate 10 containing imprint information. The print plate, for example a magnesium print plate, provides a large surface area for imprinting ingredient statements, product information, company logos, and trademarks, and may also be used with steel type which imprint one or more lines of variable information like lot numbers and expiration dates. In one embodiment, the steel type is inserted in a cutout of the typeholder 8. The printhead 2 may therefore be configured for printing with the print plate 10 alone, steel type alone, or the print plate 10 in combination with steel type. If only steel type is used in the printhead 2 for printing lines of text, then the print plate may be replaced with a thermal insulating plate which distributes imprint forces thereby preventing the steel type from damaging the substrate and print ribbon as further discussed below. The thermal insulating plate also insulates the substrate from the heated printhead 2 to prevent improper imprinting where the insulated plate contacts the substrate.

Figure 2:
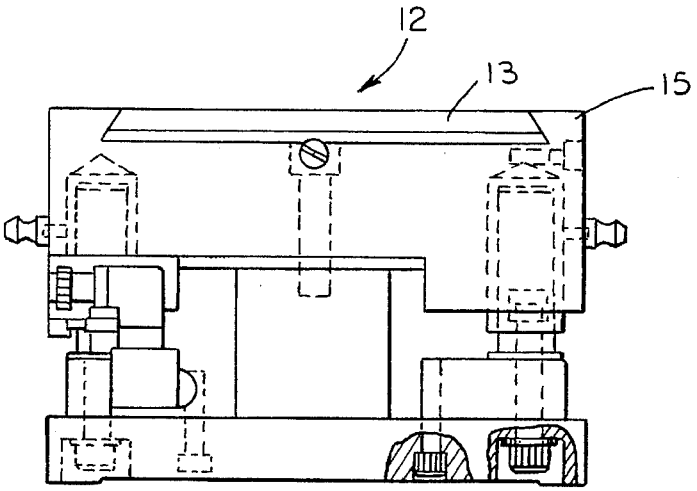
FIG. 2 is a partial sectional side view of an actuatable backup assembly and backup pad of the imprinter of FIG. 1.

The imprinter assembly 100 includes an actuatable backup assembly 12, corresponding to each printhead assembly 2, which is adjustably mounted on a lock bar 14 of the frame, and secured thereto by cap screws 16 located in lockbar slots. FIG. 2 is a partial sectional side view of a backup assembly 12 including a rubber backup pad 13 disposed on an end portion which is driven toward the printhead 2. In one embodiment, the backup pad 13 has a dovetail shape which is retained in a complementary groove on the backup assembly 12, and is secured by a clamp 15 fastenable to an end portion of the backup assembly 12 by a bolt to provide ready access to the backup pad. A similar clamp may be used to retain the print plates 10 on the printhead assemblies 2 discussed above. Each backup assembly 12 includes a slider block and air cylinder assembly 18 for moving the backup assembly 12 from a rest position, toward the printhead assembly 2 to an imprint position in which the substrate and a print ribbon are compressed between the backup pad 13 and the print plate 10 and or steel type of the heated printhead 2 for a compression period to transfer ink from the print ribbon onto the substrate. The compression period, or dwell time, is a variable which is selectable by operator input to the control unit, and depends upon the compression time required to transfer the ink from the print ribbon to the substrate. Ink transfer is dependent on characteristics like the texture and absorption rate of the substrate. The print stroke is initiated by the control unit 200, which actuates a solenoid 19 to operate an air valve 21 to route compressed air into the cylinder 18, wherein the compressed air thrusts the backup assembly 12 toward the printhead assembly 2. After the dwell time, the control unit de-actuates the solenoid 19 to remove the compressed air from the cylinder 18 which allows the backup assembly 12 to move from the imprint position back to the rest position.

The air pressure required to properly imprint the substrate depends on the surface area to be imprinted. In the exemplary embodiment, the surface area of each printhead 2 configured for imprinting with the print plate 10 combined with lines of steel type is approximately two by five inches, whereas in a printhead 2 configured for imprinting a single line of steel type without the print plate 10, the surface area is approximately one-eighth by two inches. In one embodiment, imprinting a two inch by five inch imprint area requires applying between approximately 90 and 110 psi to each backup assembly 12 for proper imprinting. Imprinting with steel type however requires less pressure to prevent the steel type from damaging the substrate and print ribbon. In steel type only imprinting, the insulated thermal plate, used in place of the imprint plate, will to some extent distribute the imprint pressure over an enlarged surface area, but the pressure must still be reduced to prevent damage to the ribbon and substrate.

Figure 3:
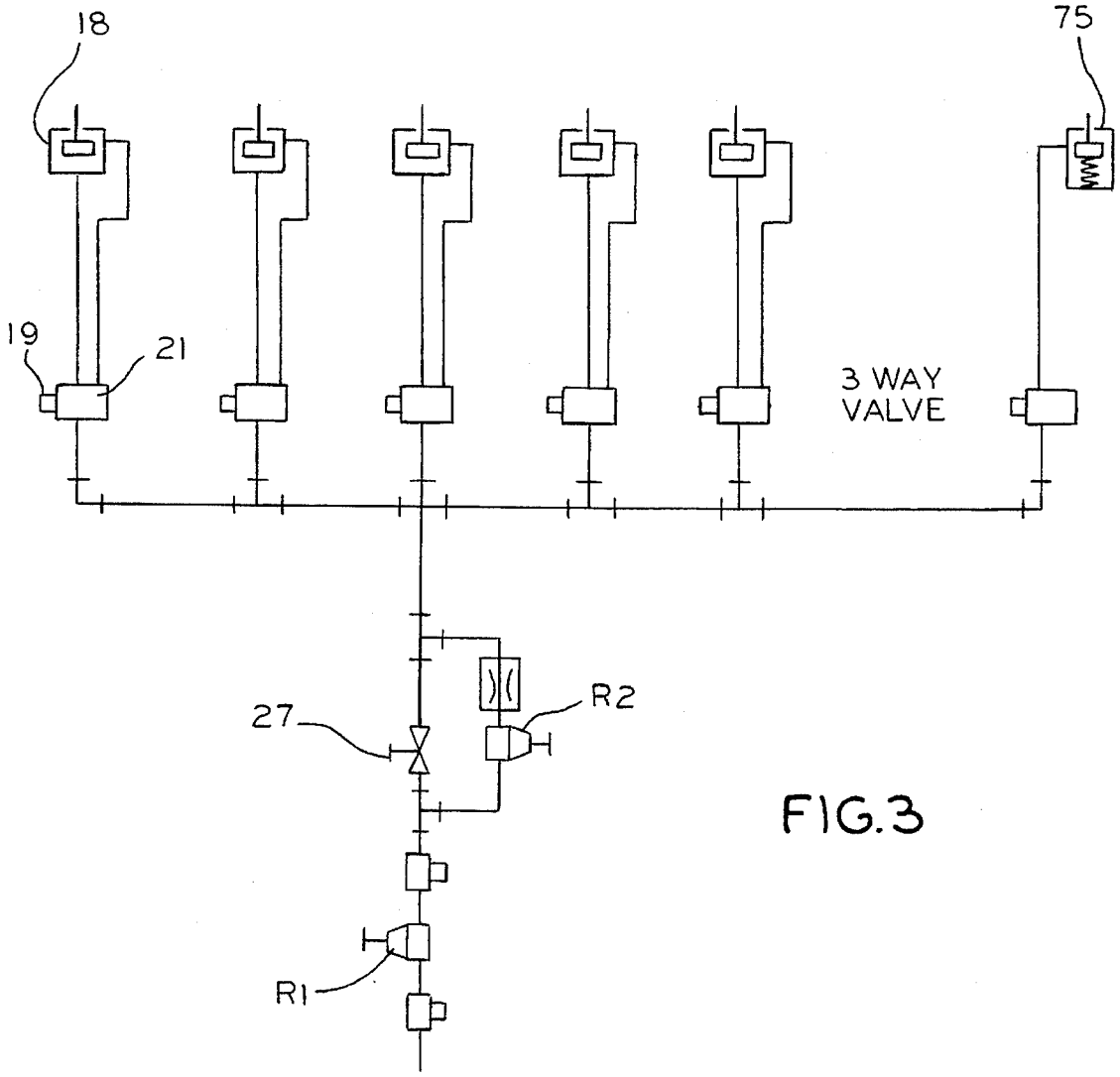
FIG. 3 is an air flow diagram which illustrates the flow of compressed air to air valves which actuate the actuatable backup assemblies of the imprinter.

To accommodate the different imprint pressure requirements of different printhead configurations as discussed above, the imprinter may be operated in different modes. FIG. 3 is an air flow diagram which illustrates the flow of compressed air to the air valves 21 which control air flow to the air cylinder assemblies 18. As shown, compressed air is provided along a conduit which includes at least one air regulator R1 to regulate air pressure unless air is supplied from a properly regulated source. The regulated compressed air is then distributed to the air valves 21 which are actuated by the solenoids 19 possibly under control of the control unit 200. In a serial mode of operation, the solenoids 19 of the backup assemblies 12 are individually and sequentially actuated to provide maximum air pressure to each backup assembly 12 as may be required for imprinting with the entire surface area of the printhead 2. The delay period between actuation of the individual solenoids 19 is input to the control unit 200 by the operator, and is selected for a time period which permits accumulation of sufficient pressure between actuation periods to properly actuate the next sequential backup assembly 12. In one embodiment, the air pressure is regulated at 100 psi, and the delay time is in a range between approximately 25 and 100 milliseconds, and in another embodiment the delay time is between approximately 50 and 75 milliseconds. In a parallel mode of operation, the solenoids 19 of the backup assemblies 12 are simultaneously actuated by the control unit 200, for parallel operation of the backup assemblies 12, to provide reduced air pressure to the backup assemblies 12 as may be required for imprinting with only a partial surface area of the printhead 2. The reduced imprint pressure thus prevents damage to the print ribbon and substrate as discussed above. For parallel operation of the backup assemblies 12, the delay time is reduced to zero. In another embodiment, a flow control valve 27 is disposed along the regulated compressed air conduit, and a second lower pressure regulator R2 is disposed along a section of conduit arranged parallel to the flow control valve 27. The flow control valve 27 may be manually actuated or automatically actuated by the control unit 200. When the control valve 27 is open, the air pressure is controlled by the regulator R1, but when the control valve 27 is closed, the air pressure is reduced by the regulator R2. An additional regulator may be disposed in a conduit arranged in parallel with regulator R2 to further reduce the air pressure, which arrangement would require an additional flow control valve to interrupt the air to the regulator R2. In one embodiment, when the printheads 2 are configured for imprinting with the print plate 10, the control valve 27 is open to provide 100 psi air pressure, and the backup assemblies 12 are actuated in series to provide maximum pressure to the actuated backup assembly 12. When the printheads 2 are configured with lines of steel type and the insulated spacer, the control valve 27 is closed to reduce the air pressure to the pressure regulated by R2, in one embodiment 30 psi. To further reduce air pressure, as may be required for some printhead configurations, the backup assemblies 12 are actuated in parallel to prevent damage to the substrate and print ribbon. Parallel operation may also be used to expedite imprinting where the selected air pressure is sufficient for the printhead configuration.

Figure 4:
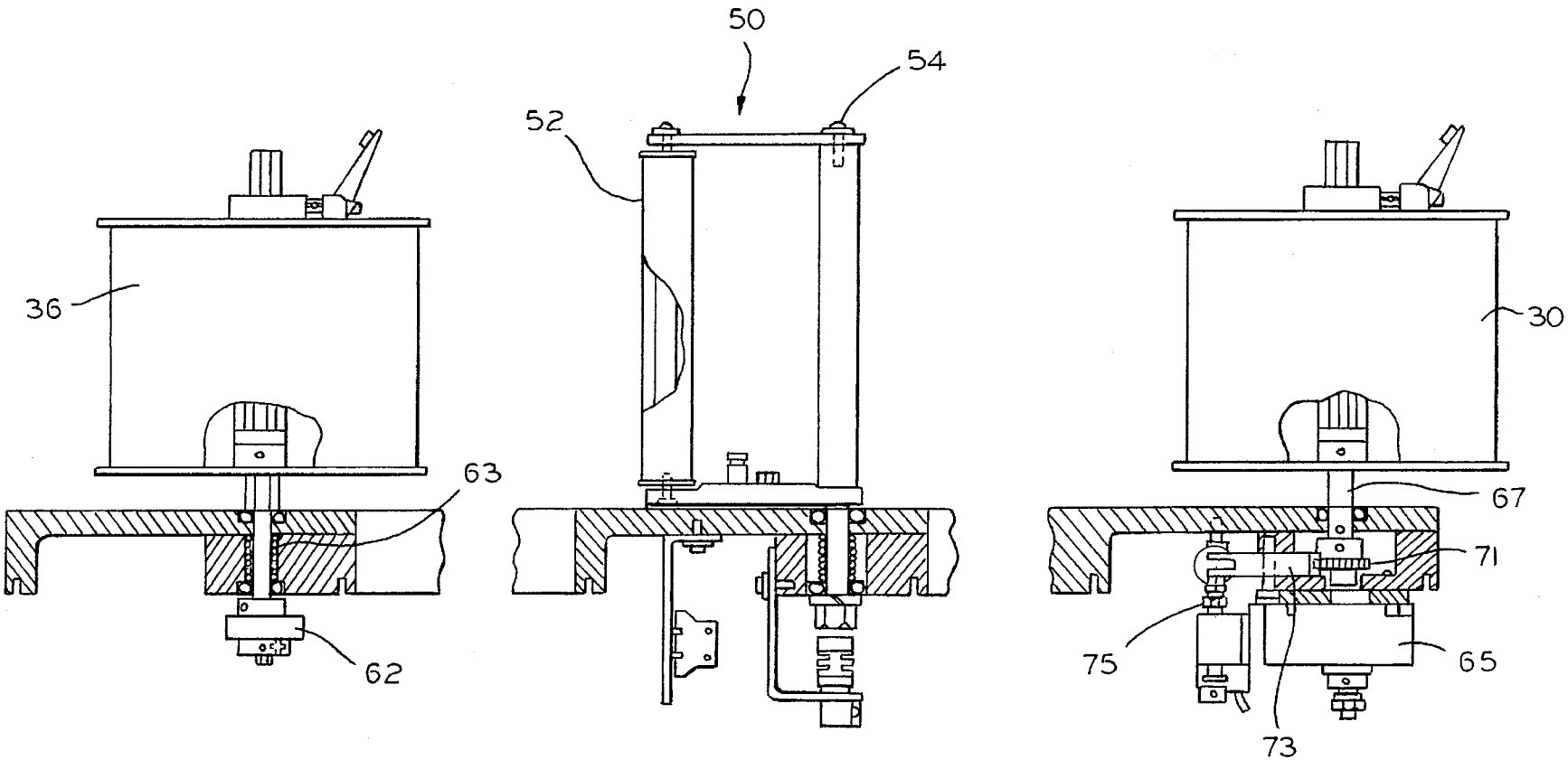
FIG. 4 is a partial sectional view of the imprinter of FIG. 1.

In FIGS. 1 and 4, a ribbon supply reel 30 having an inked print ribbon 40 is rotatably mounted on the frame of the imprinter assembly 100. The ribbon 40, supported by several idler rollers 34, is routed between the one or more printheads 2 and backup assemblies 12, and transferred to a rewind reel 36. The rewind reel 36 is driven by a stepper motor 60 possibly controlled by the control unit 200. In one embodiment, the stepper motor 60 is energized at all times and maintains tension on the print ribbon 40 between ribbon advance steps. To conserve energy and reduce heat generation, however, the stepper motor 60 may be de-energized between steps. In this energy efficient mode of operation, a one-way clutch 62 is coupled to a drive shaft 63 of the rewind reel 36 to maintain a tension on the ribbon 40 when the motor 60 is de-energized thereby preventing unwinding of the ribbon 40 from the rewind reel 36. A spring biased dancer assembly 50, having an idler roller 52, is pivotable about a pivot point 54 to maintain a tension on the ribbon 40. An encoder, for example a rotary encoder, coupled to the dancer assembly 50 controls a supply voltage to a variable electromagnetic brake 65 and indicates to the control unit 200 when the ribbon supply 30 is depleted and when the ribbon 40 is broken based on a position of the dancer assembly 50. The electromagnetic brake 65 applies drag to a shaft 67 of the supply reel 30 to provide tension on the print ribbon 40 based on a position of the dancer assembly 50. When the imprinter 100 is de-energized, the electromagnetic brake 65 is also de-energized and the supply reel 30 is free to rotate on its shaft. In one embodiment, a locking mechanism on the supply reel 30 prevents unwinding of the print ribbon 40 from the supply reel 30 under the action of the spring biased dancer assembly 50 during de-energization of the brake 65. For example, a ratchet type gear 71 fixedly coupled to the shaft of the supply reel 30 is engageable by a pawl 73 which normally engages the gear 71 under the bias action of a spring. During energization of the electromagnetic brake 65, the pawl 73 is disengaged from the gear 71 by a pneumatic actuator 75 which overcomes the bias of the spring, wherein the brake 65 then controls the tension of the supply reel 30. FIG. 3 shows the pneumatic actuator 75 and an air valve for providing compressed air to the pneumatic actuator 75. When the brake 65 is de-energized, so too is the pneumatic actuator 75, and the spring moves the pawl 73 into locking engagement with the gear 71 to prevent the rotation of the supply reel 30.

The ribbon supply/broken status may be indicated to the operator by the warning light or the auxiliary indicator as discussed above. In one embodiment, the control unit 200 is programmed to de-energize the imprinter assembly 100 when the ribbon supply is low, or in the event of a broken ribbon. A measuring roller 38, coupled to a second encoder, measures the ribbon transfer rate from the supply reel 30 to the rewind reel 36, and communicates ribbon measurement information to the control unit 200. A pressure roller 42 maintains the ribbon 40 in contact with the measuring roller 38 to prevent slippage therebetween, and to ensure accurate measurement. In one embodiment, the imprinter 100 is partially enclosed in a housing to protect operators from the imprinter 100 and to protect the imprinter 100 from the environment.

In one mode of operation, the substrate is fed, by the host packaging machine, between the one or more printhead 2 and backup 12 assemblies. In the embodiment of FIG. 1, the substrate moves into or out of the page in relation to the print ribbon 40 transfer direction. The control unit 200 individually and sequentially actuates the backup assemblies 12, as discussed above, in response to a trigger signal from the host packaging machine. After the one or more backup assemblies 12 have each been actuated for an initial imprint, the print ribbon 40 is intermittently advanced, or moved, an incremental distance, by the stepper motor 60, to advance an unused portion of the ribbon 40 between the printhead 2 and backup 12 assemblies for the next imprint. The incremental distance that the ribbon 40 is moved depends on the number, size and spacing between the printhead assemblies 2. In an imprinter with a single printhead 2 and backup 12 assembly, the ribbon 40 is moved a minimum distance necessary to position an unused portion of the ribbon 40 between the printheads 2 and backup assembly 12. In imprinters having multiple printhead 2 and backup 12 assemblies, the ribbon 40 may be moved a "short" incremental distance after the initial imprint, to utilize unused inked portions of the ribbon 40 between adjacent printheads 2 during the initial imprint. In some embodiments, it may be possible to move, the ribbon 40 several "short" incremental distances after the initial print stroke to efficiently use all unused inked portions of the print ribbon 40 between printhead assemblies 2. After the inked portions of the ribbon 40 between the printhead assemblies 2 have been depleted, the ribbon 40 must be moved a "long" incremental distance, to position an unused portion of the ribbon between the printhead 2 and backup 12 assemblies, and after a subsequent imprint, the ribbon 40 is again moved one or more "short" intervals until the ink on the ribbon 40 is depleted. The "small" and "large" incremental distances may be selectively input at the control unit 200 by the operator depending on the size, and spacing of the printhead assemblies 2.

The foregoing is a description enabling one of ordinary skill in the art to make and use the preferred embodiments of the present invention. It will be appreciated by those skilled in the art that there exist variations, modifications and equivalents to the embodiments disclosed herein. The present invention therefore is to be limited only by the scope of the appended claims.

What is claimed is:

1. A hot stamp imprinter, for imprinting ink from a print ribbon onto a substrate, comprising:

a plurality of printhead assemblies mounted upon a frame wherein each printhead has a heater element;

a plurality of backup assemblies mounted upon said frame and respectively corresponding to each one of said printhead assemblies wherein each one of said backup assemblies includes an air cylinder and a slider block operated by compressed air;

valve means fluidically connected to said air cylinders of said plurality of backup assemblies for conducting compressed air into and out of each one of said air cylinders such that said plurality of backup assemblies are movable toward said printhead assemblies from a rest position to an imprint position so as to transfer ink from a print ribbon onto a substrate when compressed air is conducted into said air cylinders, and said backup assemblies are movable from said imprint position to said rest position when compressed air is conducted out from said air cylinders; and means selectively actuating said valve means in series and parallel modes for regulating the pressure of said compressed air, supplied to said backup assemblies through said valve means, so as to move said backup assemblies from said rest position to said imprint position in accordance with said regulated pressure so as to properly cause transfer of said ink from said print ribbon onto said substrate.

2. The imprinter of claim 1, further comprising an air supply for providing compressed air to the backup assemblies, the air supply having a first regulator for providing compressed air at a first pressure, and a second regulator for providing compressed air at a second pressure lower than the first pressure, the air supply including a flow control valve for selecting the first air pressure or the second air pressure.

3. The imprinter of claim 2, wherein the first regulator is selected when the valve means are actuated in series, and actuation of the individual valve means is delayed to control air pressure supplied to the backup assemblies, the delay period between approximately 25 and 100 milliseconds.

4. The imprinter of claim 2, wherein the second regulator is selected when the valve means are actuated in parallel.

5. The imprinter of claim 1, wherein each printhead assembly further comprises a temperature probe, the heater elements of the respective printhead assemblies are individually and sequentially energized based on a temperature of the temperature probe so that only one printhead assembly is energized at any one time to conserve energy.

6. The imprinter of claim 5, wherein each printhead assembly further comprises multiple heater elements to provide a uniform temperature distribution in each printhead assembly.

7. The imprinter of claim 1, further comprising a ribbon supply reel for providing the print ribbon between the printhead and backup assemblies to a rewind reel, a stepper motor rotatably coupled to the rewind reel to transfer the print ribbon from the supply reel to the rewind reel, and an electromagnetic brake coupled to the supply reel for providing drag on the supply reel which applies tension to the print ribbon as the print ribbon is transferred from the supply reel to the rewind reel.

8. The imprinter of claim 7, further comprising a spring biased dancer assembly having an idler roller for maintaining tension on the print ribbon as the print ribbon is transferred from the supply reel to the rewind reel, the dancer assembly being coupled to a first encoder which controls the electromagnetic brake to vary the tension on the print ribbon based on a position of the dancer assembly.

9. The imprinter of claim 8, further comprising a second idler roller coupled to a second encoder for measuring the rate at which the print ribbon is transferred from the supply reel to the rewind reel, and a pressure roller for maintaining the print ribbon in contact with the second idler roller to ensure accurate measurement, wherein, after an initial imprint, the print ribbon is incremented a short interval to move an unused portion of the print ribbon between the printhead and backup assemblies, and then, after a subsequent imprint, the print ribbon is incremented a long interval to move an unused portion of the print ribbon between the printhead and backup assemblies.

10. The imprinter of claim 7, further comprising a one-way clutch coupled to the rewind reel, the one-way clutch preventing the rewind reel from unwinding the print ribbon when the stepper motor is de-energized, and a locking means coupled to the supply reel for preventing the supply reel from supplying print ribbon when the electromagnetic brake is de-energized.

11. The imprinter of claim 10, wherein the locking means comprises a gear fixed to the shaft of the supply reel, and a pawl biased by a spring into engagement with the gear to prevent rotation of the supply reel when the electromagnetic brake is de-energized, the pawl being disengaged from the gear by a pneumatic actuator when the electromagnetic brake is energized.

12. A hot stamp imprinter, for imprinting ink from a print ribbon onto a substrate, comprising:

a plurality of printhead assemblies mounted upon a frame wherein each printhead assembly has a heater element;

a plurality of backup assemblies mounted Upon said frame and respectively corresponding to each one of said printhead assemblies wherein each one of said backup assemblies includes an air cylinder and a slider block operated by compressed air;

valve means fluidically connected to said cylinders of said plurality of backup assemblies for conducting compressed air into and out of each one of said air cylinders such that said plurality of backup assemblies are movable toward said printhead assemblies from a rest position to an imprint position so as to transfer ink from a print ribbon onto a substrate when compressed air is conducted into said air cylinders, and said backup assemblies are movable from said imprint position to said rest position when compressed air is conducted out from said air cylinders;

means selectively actuating said valve means in series and parallel modes for regulating the pressure of said compresses air, supplied to said backup assemblies through said valve means, so as to move said backup assemblies from said rest position to said imprint position in accordance with said regulated pressure so as to properly cause transfer of said ink from said print ribbon onto said substrate; and pressure regulator means, disposed upstream of said valve means, comprising a first pressure regulator for regulating the pressure of said compressed air, supplied to said valve means, to a first pressure level, a second pressure regulator for regulating the pressure of said compressed air, supplied to said valve means, to a second pressure level which is lower than said first pressure level, and flow control valve means for controlling the flow of said compressed air through said first and second pressure regulators so as to regulate the pressure of said compressed air, supplied to said valve means, to said first or second air pressure level.

13. An imprinter as set forth in claim 12, further comprising:

a ribbon supply reel for providing a supply of said print ribbon to be conducted between said printhead assemblies and said backup assemblies;

a rewind reel for rewinding said print ribbon after said print ribbon has passed between said backup assemblies and said printhead assemblies;

a stepper motor rotatably coupled to said rewind reel so as to drive said rewind reel and cause said print ribbon to be transferred from said ribbon supply reel to said rewind reel;

an electromagnetic brake coupled to said ribbon supply reel for providing drag upon said ribbon supply reel and thereby apply tension to said print ribbon as said print ribbon is transferred from said ribbon supply reel to said rewind reel;

a spring-biased dancer assembly having an idler roller for maintaining tension upon said print ribbon as said print ribbon is transferred from said ribbon supply reel to said rewind reel; and a first encoder operatively connected to said dancer assembly for controlling said electromagnetic brake, so as to vary said tension upon said print ribbon, as a function of the position of said dancer assembly.

14. The imprinter of claim 13, further comprising a one-way clutch coupled to the rewind reel, the one-way clutch preventing the rewind reel from unwinding the print ribbon when the stepper motor is de-energized, and a locking means coupled to the supply reel for preventing the supply reel from supplying print ribbon when the electromagnetic brake is de-energized.

15. The imprinter of claim 14, wherein the locking means comprises a gear fixed to the shaft of the supply reel, and a pawl biased by a spring into engagement with the gear to prevent rotation of the supply reel when the electromagnetic brake is de-energized, the pawl being disengaged from the gear by a pneumatic actuator when the electromagnetic brake is energized.

16. The imprinter of claim 15, further comprising a second idler roller coupled to a second encoder for measuring the rate at which the print ribbon is transferred from the supply reel to the rewind reel, and a pressure roller for maintaining the print ribbon in contact with the second idler roller to ensure accurate measurement, wherein, after an initial imprint, the control unit increments the print ribbon a short interval to move an unused portion of the print ribbon between the printhead and backup assemblies, and then, after a subsequent imprint, the control unit increments the print ribbon a long interval to move an unused portion of the ribbon between the printhead and backup assemblies.

17. A method of imprinting ink from a print ribbon onto a substrate, comprising the steps of:

providing an imprinter with a plurality of printhead assemblies wherein each printhead assembly has a heating element, and a corresponding pneumatically-actuated backup assembly which is movable toward its corresponding printhead assembly from a rest position to an imprint position so as to transfer ink from a print ribbon to a substrate;

selectively actuating said pneumatically-actuated backup assemblies in series and parallel modes so as to regulate the pressure of the compressed air, supplied to said pneumatically-actuated backup assemblies, and thereby move said pneumatically-actuated backup assemblies from said rest position to said imprint position in accordance with said regulated pressure so as to properly cause transfer of said ink from said print ribbon onto said substrate;

moving said backup assemblies from said imprint position to said rest position after imprinting upon said substrate; and incrementing said print ribbon between said printhead assemblies and said backup assemblies so as to position an unused portion of said print ribbon between said printhead assemblies and said backup assemblies.

18. The method of claim 17, further comprising steps of measuring the temperature of the individual printhead assemblies with a temperature probe, and energizing the printhead assemblies to maintain a uniform temperature distribution throughout the printhead assemblies; and sequentially and individually energizing the heater element of the respective printhead, so that only one printhead assembly is energized at any one time to conserve energy.

19. The method of claim 18, further comprising steps of maintaining tension in the print ribbon while the print ribbon is incremented from a supply reel to a rewind reel with a spring biased dancer assembly having an idler roller over which the print ribbon feeds, and applying a drag on the supply reel based on a position of the spring biased dancer assembly to control the tension of the print ribbon.

20. The method of claim 10, further comprising a step of measuring the rate at which the print ribbon is transferred from the supply reel to the rewind reel with a second idler roller coupled to an encoder.

21. The method of claim 18, further comprising the steps of:

incrementing said print ribbon with a stepper motor;

de-energizing said stepper motor between steps;

preventing said print ribbon from unwinding from said rewind reel by means of a one-way clutch when said stepper motor is de-energized; and preventing said print ribbon from unwinding from said supply reel when said stepper motor is de-energized.

22. A hot stamp imprinter, for imprinting ink from a print ribbon onto a substrate, comprising:

a plurality of printhead assemblies mounted upon a frame wherein each printhead has a heater element;

a plurality of backup assemblies mounted upon said frame and respectively corresponding to each one of said printhead assemblies, wherein each one of said backup assemblies includes an air cylinder and a slider block operated by compressed air;

valve means fluidically connected to said air cylinders of said plurality of backup assemblies for conducting compressed air into and out from each one of said air cylinders such that said plurality of backup assemblies are movable toward said printhead assemblies from a rest position to an imprint position so as to transfer ink from a print ribbon onto a substrate when compressed air is conducted into said air cylinders, and said backup assemblies are movable from said imprint position to said rest position when compressed air is conducted out from said air cylinders; and pressure regulator means for regulating the pressure of said compressed air, supplied to said backup assemblies through said valve means, to at least two different pressure levels so as to move said backup assemblies from said rest position to said imprint position in accordance with said regulated pressure and thereby properly cause transfer of said ink from said print ribbon onto said substrate.

* * * * *